US005704759A

United States Patent [19]

Draskovich et al.

[11] Patent Number: 5,704,759

[45] Date of Patent: Jan. 6, 1998

[54] ABRASIVE TIP/ABRADABLE SHROUD SYSTEM AND METHOD FOR GAS TURBINE COMPRESSOR CLEARANCE CONTROL

[75] Inventors: Barry S. Draskovich, Scottsdale; Norman E. Frani, Phoenix; Stephen S. Joseph, Chandler, all of Ariz.; Dave Narasimhan, Flemington, N.J.

[73] Assignee: AlliedSignal Inc., Morris Township, N.J.

[21] Appl. No.: 734,756

[22] Filed: Oct. 21, 1996

[51] Int. Cl.[6] ..... F01D 5/00

[52] U.S. Cl. ..... 415/170.1; 415/200

[58] Field of Search ..... 415/170.1, 174.4, 415/200; 416/241 R

[56] References Cited

U.S. PATENT DOCUMENTS

| | | | |
|---|---|---|---|
| 4,169,020 | 9/1979 | Stalker et al. . | |
| 4,227,703 | 10/1980 | Stalker et al. . | |
| 4,232,995 | 11/1980 | Stalker et al. . | |
| 4,336,276 | 6/1982 | Bill et al. | 415/174.4 |
| 4,551,064 | 11/1985 | Pask | 415/200 |
| 4,589,823 | 5/1986 | Koffel . | |
| 4,741,973 | 5/1988 | Condit et al. . | |
| 4,744,725 | 5/1988 | Matarese et al. . | |
| 4,764,089 | 8/1988 | Strangman | 415/174.4 |
| 4,842,953 | 6/1989 | Perkins et al. | 416/241 R |
| 4,914,794 | 4/1990 | Strangman | 29/889.1 |
| 4,936,745 | 6/1990 | Vine et al. . | |
| 4,937,042 | 6/1990 | Perkins et al. | 419/8 |
| 5,059,095 | 10/1991 | Kushner et al. | 415/200 |
| 5,264,011 | 11/1993 | Brown et al. . | |
| 5,352,540 | 10/1994 | Schienle et al. | 415/170.1 |
| 5,355,637 | 10/1994 | Wiltshire et al. . | |
| 5,506,055 | 4/1996 | Dorfman et al. . | |
| 5,530,050 | 6/1996 | Rangaswamy . | |

*Primary Examiner*—John T. Kwon
*Attorney, Agent, or Firm*—James W. McFarland

[57] ABSTRACT

For use in a compressor unit of gas turbine engine, a blade having a tip portion. An abrasive portion is formed on the tip portion with the abrasive portion comprising a dispersion of discrete particles of cubic boron nitride disposed on the tip portion. A shroud is coated with a porous ceramic abradable material based on preferably 8% yttria-stabilized zirconia. The abrasive portion of the tip portion contacts the abradable material. In the preferred embodiment, the abradable material is treated with boron nitride composited polyester that is burned out of the material via thermal exposure to thereby improve porosity within the abradable material.

6 Claims, 1 Drawing Sheet

ABRASIVE TIP/ABRADABLE SHROUD SYSTEM AND METHOD FOR GAS TURBINE COMPRESSOR CLEARANCE CONTROL

TECHNICAL FIELD

This invention relates generally to a compressor blade and shroud for use in a turbine engine, and more particularly, to a compressor blade having an abrasive tip and an abradable shroud for controlling clearance within the gas turbine engine compressor.

Background of the Invention

Abradable coatings have been successfully adopted as an industry standard for use in compressor blade clearance control applications. The primary function of these coatings is to provide a rub-tolerant shroud surface that minimizes blade damage in the event a compressor blade rubs the shroud surface. The abradable surface permits engine operation at relatively "tight" tip clearances with attendant benefits in compressor efficiency, i.e., maximum air through the compressor blades for better performance and compression.

Low cost abradable coatings enable compressors to operate at minimum clearance by protecting air foils from non-repairable damage (excessive tip wear and bent blades) during rub events. In the absence of abradable coatings, tip incursions into a bare metal shroud may result in considerable, nonrepairable damage to the impeller. Increasing the tip clearance to avoid the rubs may also yield unacceptable losses in performance due to lower compressor efficiency and higher turbine temperatures. Tip clearances can be set tight by incorporating abradable coatings that allow for slight rubs without the impeller damage associated with the uncoated shroud design.

The three most common high pressure compressor (HPC) coatings are SF aluminum, Metco 52C, and nickel-graphite. These abradable systems have displayed various levels of performance deficiencies related to coating durability, post-rub surface finish, as-machined surface finish, fire risk, erosion, corrosion, and impeller damage. Durability, surface finish, fire issues, and nonrepairable impeller damage are the most common concerns with the aluminum abradables.

One of the challenges associated with the use of abradables is the fact that the coating properties that promote rub-tolerance, such as friability and/or low shear strength, can result in compromises in shroud surface finish, and in some cases, coating durability. Aluminum-based coatings fit the category of being easily sheared during a rub without necessarily being porous, and for this reason offer an excellent surface finish. This is especially true in the case of the aluminum-based coatings historically used in many HPC impeller shroud applications. They offer excellent surface finish but their long-term use in HPC applications is ultimately limited by melting point and lack of thermal durability.

More specifically, as the temperature of the aluminum-based coating increases, it tends to get "gummy" and the blade tip will smear it around the shroud, thereby creating grooves within the coating that allow air to pass past the blade tip as opposed to between the blades, which deteriorates performance of the compressor. The grooves also cause turbulent air flow at the shroud surface. Additionally, the aluminum-based coating can corrode. Also, under the right combination of operating conditions, rub debris from an aluminum coating can ignite, and the heat of aluminum combustion can in turn ignite a titanium compressor rotor fire.

Accordingly, apparatus and a method are needed that overcome the shortcomings of the prior art by providing an abrasive tip/abradable shroud system and method for gas turbine compressor clearance control.

SUMMARY OF THE INVENTION

A compressor unit of a gas turbine engine according to the present invention addresses the shortcomings of the prior art.

In accordance with one aspect of the present invention, a compressor unit of a gas turbine engine comprises a blade body having a tip portion. An abrasive portion is formed on the tip portion with the abrasive portion comprising a dispersion of discrete particles of cubic boron nitride disposed on the tip portion. A shroud is coated with a porous ceramic abradable material based on 7–9% yttria-stabilized zirconia, and preferably 8% yttria-stabilized zirconia. The abrasive portion of the tip portion contacts the abradable material.

In accordance with a further aspect of the invention, the abradable material is treated with hexagonal boron nitride composited polyester that is burned out of the material via thermal exposure to thereby improve porosity within the abradable material.

BRIEF DESCRIPTION OF THE DRAWINGS

The present invention will hereinafter be described in conjunction with the appended drawing figures, wherein like designations denote like elements, and.

DETAILED DESCRIPTION OF THE PREFERRED EMBODIMENT

Figure 1:
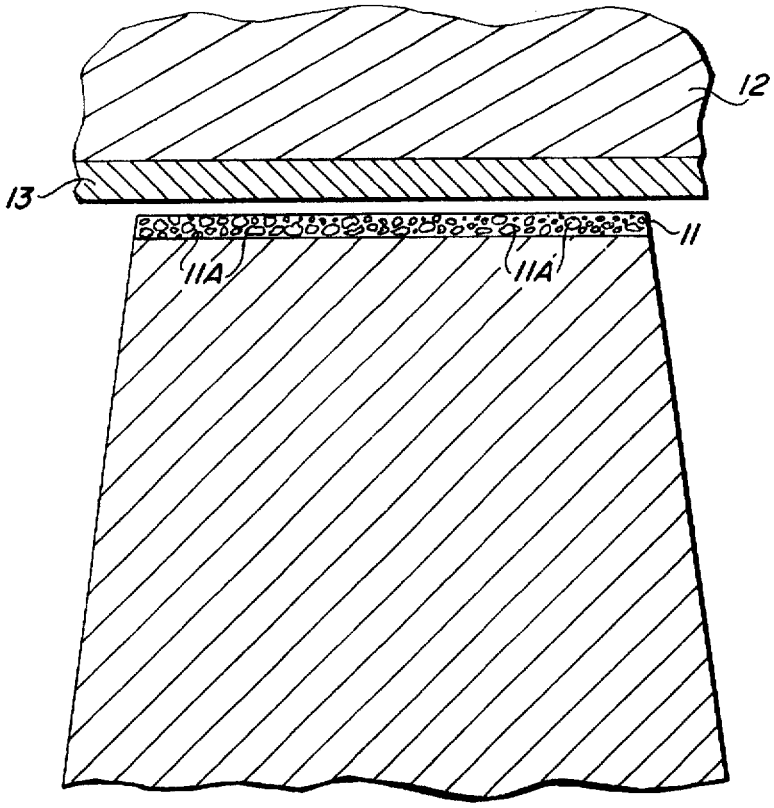
FIG. 1 is a sectional view of a blade and blade tip of a compressor unit shown in relation to a shroud having a shroud substrate.

FIG. 1 illustrates a portion of a blade 10 of a compressor unit within a gas turbine engine. For purposes of this invention, the compressor can be either an axial compressor (blade type) or a centrifugal compressor (impeller type). Blade 10 is generally made of titanium.

Figure 2:
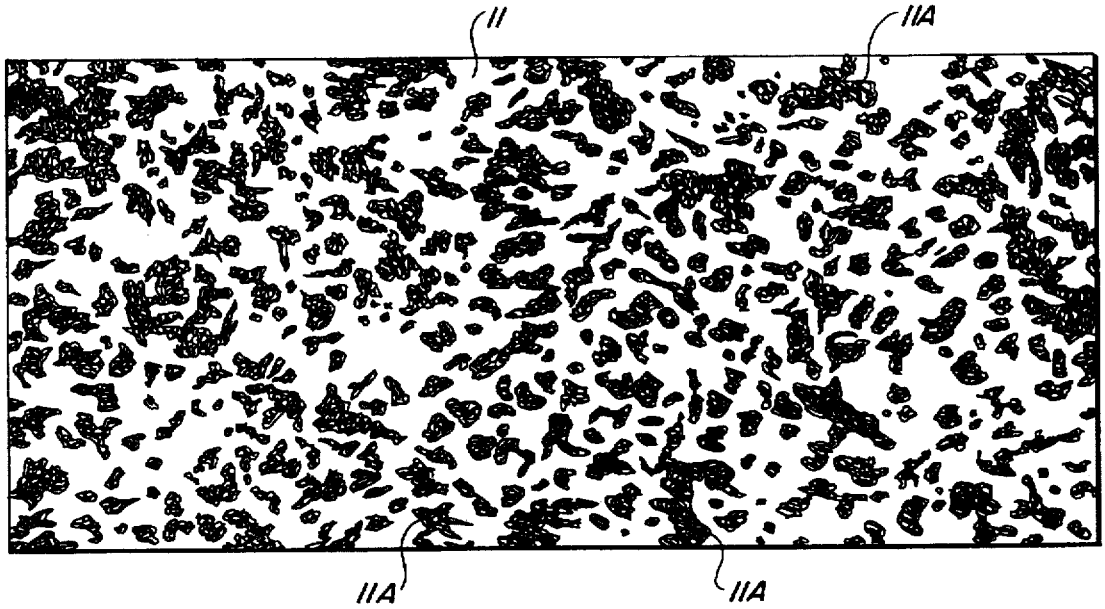
FIG. 2 is a radial view of a CBN-tipped Ti-6-2-4-2 blade showing abrasive distribution over the tip surface.

Blade 10 further has an abrasive tip 11, generally a nickel plate, that has abrasive particles 11A embedded therein. These particles are cubic boron nitride. This abrasive tip portion 11 is attached to Blade 10 via an Entrapment Plating process. In this process, cubic boron nitride particles are attached to tip 10 by means of a nickel plate coating. In essence, the particles are "trapped" into the nickel plate during the plating operation. A company that performs this process is Abrasive Technology, Inc. in Columbus, Ohio. FIG. 2 illustrates the distribution of abrasive particles 11A within the nickel plate. Other processes can also be utilized to embed the particles including using a laser, a transfer arc or an electron beam.

A shroud substrate 12 envelopes the compressor unit. The shroud substrate has an abradable coating or liner 13 attached thereto. In the preferred embodiment the shroud coating is based on a thermal barrier coating, yttria-stabilized zirconia, in the range of 7–9%, and most preferably, 8% yttria-stabilized zirconia. Additionally in the preferred embodiment, the abradable coating has an increased level of porosity that is achieved through the addition of polyester particles, preferably 5 wt % boron nitridecomposited polyester powder. A manufacturer of the powder is Sulzer Plasma Technik in Troy, Mich. Subsequent to spraying of the coating onto shroud 12, the polyester is burned out via thermal exposure, resulting in uniformly distributed porosity.

In operation, blade tip 11 contacts abradable coating 13 to thereby form a seal to prevent air from passing over the blade tip, thereby forcing air to pass between adjacent blades. Also referred to as rub, this contact between the blade tip and the abradable coating seals the rotor, which minimizes clearances thereby improving performance and efficiency of the compressor.

Cubic boron nitride is utilized on tip 11 because it is an extremely hard material almost equal to the hardness of diamond. Its use in the cutting tips of airfoil blades in a gas turbine engine is well documented. In order to maximize the efficiency of the blade tip, clearances are made small to minimize gas leakage and turbulence over the blade tips. Abradable coating 13 is sprayed on shroud substrate 12, which encircles all blades of the compressor. Because of its extreme hardness, cubic boron nitride improves the efficiency of the blades in cutting a path into the abradable coating. Unfortunately, cubic boron nitride is not temperature tolerant for long periods of time. In fact, at temperatures of 1,200 to 1,300 degrees Fahrenheit, cubic boron nitride begins oxidizing. However, because the compressor unit of the gas turbine engine is not subjected to the high temperatures associated with other portions of the gas turbine engine, it is possible to use both the cubic boron nitride on tip 11 and yttria-stabilized zirconia in abradable coating 13 since the temperature within the compressor unit generally does not exceed 1,100 degrees Fahrenheit.

Yttria-stabilized zirconia abradable coating 13 has increased temperature capabilities over the prior art aluminum-based coatings, nickel graphite and other commonly used compressor abradable coatings. These increased capabilities lead to improved abradability results of no coating melting and pull out, no metal transferred to the blade tip and a wear ratio (shroud wear/blade wear) of approximately 10.0. Also, there is lower thermal distortion of the shroud, tighter build and operating clearances and elimination of compressor fires. The latter is due to blade incursion into the abradable coating 13 resulting in low frictional heat generation and non-flammable rub debris. Also, use of yttria-stabilized zirconia abradable coating 13 results in elimination of oxidation/corrosion problems.

The benefits of cubic boron nitride abrasively-tipped blade 10 include efficient cutting of ceramic shroud coating 13 during a rub event with insignificant damage or wear to the blade tip. Long-term stability of the abrasive in the tip, leading to tip protection from potential rubs throughout core life and reduced cost of repair subsequent to a blade rub due to the need to only replace the shroud coating from time to time.

It will be understood that the foregoing description is that of a preferred exemplary embodiment of the invention, and that the invention is not limited to the specific form shown and described. Various modifications may be made in the design and arrangement of the elements set forth herein without departing from the scope of the invention as expressed in the appended claims.

We claim:

1. A compressor unit of a gas turbine engine comprising:

a. a blade body having a tip portion;

b. an abrasive portion formed on said tip portion, said abrasive portion comprising a dispersion of discrete particles of cubic boron nitride disposed on said tip portion; and, c. a shroud coated with a porous ceramic abradable material based on 7–9% yttria-stabilized zirconia, said abrasive portion contacting said abradable material.

2. The unit of claim 1 wherein said abradable material is treated with Boron Nitride-composited polyester that is burned out via thermal exposure to improve porosity within said abradable material.

3. For use in a compressor unit of a gas turbine engine, a blade and a shroud, said blade comprising a blade body having a tip portion with an abrasive portion formed thereon comprising a dispersion of discrete particles of cubic boron nitride disposed on said tip portion, and, said shroud being coated with a porous ceramic abradable material based on 7–9% yttria-stabilized zirconia.

4. A method of forming an abrasive blade tip/abradable shroud system for gas turbine compressor clearance control, said method comprising:

a. forming an abrasive tip on a blade body by entrapping cubic boron nitride particles within a blade tip portion; and, b. forming an abradable shroud coating comprised of a porous ceramic abradable material based on 7–9% yttria-stabilized zirconia by attaching said coating to a shroud substrate.

5. The method of claim 4 wherein said cubic boron nitride particles are entrapped within a nickel plate blade tip portion during nickel plate coating.

6. The method of claim 5 wherein said abradable shroud is further formed by treating said abradable material with boron nitride-composited polyester that is burned out via thermal exposure to improve porosity within said abradable material.

* * * * *